US007064495B2

(12) United States Patent
Lürkens et al.

(10) Patent No.: US 7,064,495 B2
(45) Date of Patent: Jun. 20, 2006

(54) ELECTRONIC CIRCUIT AND METHOD OF SUPPLYING ENERGY TO A HIGH-PRESSURE GAS-DISCHARGE LAMP

(75) Inventors: Peter Lürkens, Aachen (DE); Holger Mönch, Vaals (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 16 days.

(21) Appl. No.: 10/506,271

(22) PCT Filed: Feb. 26, 2003

(86) PCT No.: PCT/IB03/00710

§ 371 (c)(1),
(2), (4) Date: Aug. 31, 2004

(87) PCT Pub. No.: WO03/075618

PCT Pub. Date: Sep. 12, 2003

(65) Prior Publication Data

US 2005/0225262 A1 Oct. 13, 2005

(30) Foreign Application Priority Data

Mar. 5, 2002 (DE) ..... 102 09 631

(51) Int. Cl.
*H05B 37/02* (2006.01)

(52) U.S. Cl. ..... 315/224; 315/246; 315/307

(58) Field of Classification Search ..... 315/209 R, 315/224, 246, 283, 291, 307, 308, 360
See application file for complete search history.

(56) References Cited

U.S. PATENT DOCUMENTS

| | | | | |
|---|---|---|---|---|
| 4,914,356 | A * | 4/1990 | Cockram | 315/307 |
| 5,491,388 | A * | 2/1996 | Nobuyuki et al. | 315/308 |
| 6,081,104 | A * | 6/2000 | Kern | 323/268 |
| 6,181,084 | B1 * | 1/2001 | Lau | 315/291 |
| 6,278,245 | B1 | 8/2001 | Li et al. | 315/307 |
| 6,552,498 | B1 * | 4/2003 | Prasad et al. | 315/244 |

FOREIGN PATENT DOCUMENTS

| | | | |
|---|---|---|---|
| JP | 409069395 | A * | 3/1997 |
| JP | 2000133482 | | 5/2000 |
| WO | WO 9501712 | | 1/1995 |

* cited by examiner

*Primary Examiner*—Thuy Vinh Tran

(57) ABSTRACT

The invention relates to an electronic circuit and a method of supplying energy to a high-pressure gas-discharge lamp H, 65, 75. The electronic circuit comprises a line-supply input section 62, 72 to receive and convert an a.c. voltage from an a.c. line-supply system 61, 71, an energy storage means 63, 73 to store the energy put out by the line-supply input section 62, 72 and a lamp-current regulating unit 64, 74 that is supplied with an input voltage U1 by the line-supply input section 62, 72 via the energy storage means 63, 73 and that makes available a lamp current I2 for a high-pressure gas-discharge lamp II, 65, 75. To make it possible for the energy storage means 63, 73 to be particularly small, it is proposed that the lamp-current regulating unit 64, 74 have a power section L, D, C, S, A1, A2, K having a transconductive property. If there is a drop in the input voltage U1, this property then automatically produces a reduction in the lamp current I2 made available to a high-pressure gas-discharge lamp 65, 75, H. This ensures a particularly fast adjustment to voltage fluctuations. The invention also relates to a corresponding method.

14 Claims, 6 Drawing Sheets

ELECTRONIC CIRCUIT AND METHOD OF SUPPLYING ENERGY TO A HIGH-PRESSURE GAS-DISCHARGE LAMP

This Application is a National Phase Application 35 U.S.C. 371 claiming the benefit of PCT/IB03/00710 filed on Feb. 26, 2003, which has priority based on a Germany Application No. 102 09 631.7 filed on Mar. 5, 2002.

The invention relates to an electronic circuit and a method of supplying energy to a high-pressure gas-discharge lamp. The electronic circuit comprises a line-supply input section to receive and convert an a.c. voltage from an a.c. line-supply system and an energy storage means to store the energy put out by the supply input section. The electronic circuit also comprises a lamp-current regulating unit that is supplied with an input voltage by the line-supply input section via the energy storage means and that makes available a lamp current for a high-pressure gas-discharge lamp.

High-pressure gas-discharge lamps, such as the UHP lamps made by Philips, are known from the prior art. High-pressure gas-discharge lamps are, for example, the most important light source for the small video and computer projectors which, over the past few years, have almost entirely replaced the well-known overhead projectors. The physical properties of these lamps make it possible for very small but bright projection systems to be manufactured. Not the least of the things that are made possible by the miniaturization are major cost-savings, particularly on the active display elements and the optical components.

However, compared with conventional incandescent bulbs and low-pressure gas-discharge lamps, such high-pressure gas-discharge lamps do have the disadvantage that they cannot immediately be re-ignited once they have extinguished. The reason for this is that the high operating pressure of up to 200 bars, which is present in the discharge vessel shortly after the lamp is switched off, makes the gas filling an almost perfect and hence breakdown-resistant insulator. Before the lamp can be ignited again, it must therefore cool down sufficiently to allow the internal pressure to drop back down to substantially lower levels, e.g. to 5 bars. Depending on the construction of the lamp and the conditions under which it is operating, this may require a period of up to several minutes.

It is possible for the lamp to be re-ignited instantly after extinguishing simply by re-applying the operating voltage, because initially there are still enough charge carriers present. However, the charge carriers will have decayed after only approximately 100 μs, so any extinction of the lamp, even only a brief one, should be avoided in any projector which is implemented in practice.

The lamp of a projector is normally supplied from the public a.c. line-supply system with the help of a power supply. It does, however, happen that the line-supply voltage from the a.c. line-supply system is interrupted for brief periods or that its value is lower than the nominal value. To buffer out failures of this kind, use is usually made in the power supply of energy storage means that are able to store a sufficiently large amount of energy and make it available when required. Energy storage means that can be considered are, in particular, electrolytic capacitors.

To allow a power supply of this kind to be illustrated, FIG. 1 shows, in the form of a block circuit diagram, a typical electronic circuit known in practice for supplying power to a high-pressure gas-discharge lamp.

The circuit comprises firstly a line-supply input section 12, which performs a rectifying function and voltage regulating function and is connected to a public a.c. line-supply system 11. The a.c. line-supply system 11 should provide an r.m.s. voltage of between 85 V and 264 V in this case. Connected to the line-supply input section 12 is a lamp-current regulating unit 14 that performs the function of a current regulator. The high-pressure gas-discharge lamp 15 that is to be supplied with energy by the circuit is connected to this lamp-current regulating unit 14. Also, the connection between the line-supply input section 12 and the lamp-current regulating unit 14 is connected to ground via an electrolytic capacitor 13 that is used as an energy storage means. Facilities for measuring the lamp voltage and current (not shown) are also often provided for the purpose of lamp-current regulation.

To operate the lamp 15, the line-supply input section 12 rectifies the line voltage applied to it and feeds the electrolytic capacitor 13 with the rectified voltage. Under normal circumstances the line-supply input section 12 uses its voltage regulating function to ensure that a mean voltage of, for example, 400 V is obtained in this case at the energy storage means 13, which voltage is independent of the nominal line voltage in the given case. As a result, the electrolytic capacitor 13 provides the lamp-current regulating unit 14 with a substantially constant voltage as its input voltage. The lamp-current regulating unit 14 in turn supplies the high-pressure gas-discharge lamp 15 with current in such a way that a constant mean power is obtained at the lamp. To operate a.c. lamps, the lamp 15 also has connected upstream of it an inverter (not shown) that converts the direct current supplied by the lamp-current regulating unit 14 into alternating current before the current is fed to the lamp 15. This, however, is immaterial as far as the workings of the present invention are concerned and it will, therefore, only be operation with a d.c. lamp that is dealt with by way of example in what follows.

The lamp-current regulating unit 14 is typically able to maintain the current to the lamp only until such time as the input voltage to the lamp-current regulating unit 14 drops below a certain minimum level $U_{min}$. This minimum level $U_{min}$ usually depends in this case on the lamp voltage, which rises as the elapsed life of the lamp becomes longer, and on the basic circuit of the lamp-current regulating unit 14. In the case of a so-called buck converter, the minimum permitted input voltage is approximately the same as the lamp voltage. As soon as the energy storage means 13 has discharged to this level, the lamp goes out. So, to obtain the longest possible buffering time, it is necessary either to use a large storage capacitor 13 or to have as high as possible a capacitor voltage available when a reduced line voltage begins. The maximum input voltage $U_{max}$ to the lamp-current regulating unit depends on limits to which the components of the electronic circuit are subject, and not least on the maximum permitted voltage across the storage capacitor 13. A usual figure for the maximum input voltage $U_{max}$ that applies when rectifying the voltages that normally occur on the a.c. line-supply system is approximately 400 V.

If there is a complete outage of the line supply, only the storage capacitor 13 will be left to supply energy to the lamp-current regulating unit 14. The waveform of the input voltage U(t) is then given by the following equation:

$$U(t) = \sqrt{U_{\max}^2 - \frac{2}{C_{Elcap}}\left(\frac{1}{\eta} P_{Lamp} \cdot t\right)}$$

In this equation, η is the efficiency of the lamp-current regulating unit, t the elapsed time in seconds since the outage occurred and $C_{Elcap}$ the size of the electrolytic capacitor in farads. In the event of a complete interruption to the line voltage, the minimum voltage $U_{min}$ at which the lamp goes out is reached after a time $t_{max}$. This time $t_{max}$ can be calculated from the above equation as:

$$t_{\max} = \frac{\eta \cdot (U_{\max}^2 - U_{\min}^2) \cdot C_{Elcap}}{2 \cdot P_{Lamp}}$$

Interruptions of this kind to the line voltage regularly occur on all power supply systems. However, at least in the industrialized nations, they are confined to very short durations, generally of less than 20 ms. If the energy storage means is designed for a buffering time of 20 ms, then it will only be in very rare cases that the lamp extinguishes due to an interruption in the line-supply voltage.

If an undervoltage, which may last for up to several 100 ms, occurs on the line-supply system, there is also a residual level of power $P_{Resid}$ that continues to be supplied via the line-supply input section and that has to be considered. Most projectors are designed for world-wide operation, i.e. for a line voltage of between 85 $V_{rms}$ and 264 $V_{rms}$, so there are not normally any problems at a nominal voltage of 230 V. The position is different, however, when operation is taking place on a 110 V line supply, e.g. in Japan or the USA. In this case, an undervoltage means that a projector is operated for a few 100 ms at only 50 $V_{rms}$. If the power supply was originally designed for a maximum input current that is still able to give the nominal power at 85 $V_{rms}$, the residual power in the present example would be approximately 59% of the nominal power.

Allowing for a residual power supplied by the line-supply input section of $P_{Resid50\%}$, the waveform of the input voltage $U_{50\%}(t)$ to the lamp-current regulating unit can be obtained from the equation:

$$U_{50\%}(t) = \sqrt{U_{\max}^2 - \frac{2}{C_{Elcap}}\left(\left(\frac{1}{\eta}P_{Lamp} - P_{Resid50\%}\right)\cdot t\right)}$$

In the equation, the subscript "50%" in the variable $U_{50\%}(t)$ represents, by way of example, a reduction in the line voltage to 50% of the nominal voltage. In the event of an undervoltage, the minimum voltage $U_{min}$ at which the lamp extinguishes is reached after a time $t_{max50\%}$ and this time $t_{max}$ can be obtained from a converted version of the above equation.

$$t_{\max 50\%} = \frac{(U_{\max}^2 - U_{\min}^2) \cdot C_{Elcap}}{2 \cdot \left(\frac{P_{Lamp}}{\eta} - P_{Resid50\%}\right)}$$

If all that occurs is an undervoltage of the line voltage, then due to the residual power from the a.c. line supply the buffering time is longer than it is when there is a complete interruption in the line-supply voltage. However, since an undervoltage may last for a considerably longer time than an interruption, the buffering time that is provided by a capacitor designed only for an interruption may not be long enough for undervoltages.

Given the known buffering time required and the known operating data, it is possible to determine from the equations given above the minimum capacitance required for the storage capacitor 13, the answer being the usual sizes employed in projectors. In designing the circuit, the buffering time required is set in this case in particular in such a way that, given the expected statistical behavior by the line voltage, it is only very seldom that the lamp will go out.

An essential purpose of the storage capacitor is thus to buffer out line-supply outages or undervoltages on the line-supply system in such a way that the lamp can be prevented from going out. Since the lamp continues to be operated at the nominal power even during the buffering, the user is not in any way aware of the disruptions to the line-supply voltage, which do not occur very often anyway. A storage capacitor that is able to provide buffering of this kind is, however, the largest and also the most expensive individual component in the power supply and thus makes a significant contribution to the overall size of the power supply. Particularly in the case of very small units, the considerable size of the electrolytic capacitor is something of a nuisance.

It is, therefore, of great interest for the energy storage means in an electronic circuit for supplying energy to high-pressure gas-discharge lamps to be kept as small as possible, while at the same time it has to be ensured that the lamp will not go out if there are voltage dips.

In Japanese patent application JP 2000133482, it is proposed that a lamp-power regulating system be extended by sensing the capacitor voltage and, if the capacitor voltage drops, bringing into operation a regulator that reduces the lamp power. As shown by the equation given above, it is possible in this way to obtain a long buffering time without the lamp going out even when using quite a small capacitor. There is, however, a problem with this approach in ensuring that the additional regulating element responds quickly enough to allow the lamp power to be brought down in good time. Something which makes this particularly difficult is the fact that, when using a small energy storage means, considerable fluctuations in the voltage waveform at the energy storage means occur simply as a result of the non-constant flow of power on the supply system.

It is therefore an object of the invention to provide an improved electronic circuit having a small energy storage means, for supplying energy to a high-pressure gas-discharge lamp. A particular object of the invention is to ensure, in an electronic circuit of this kind, a particularly fast response to a dip in the line voltage, in order in this way to be very certain of preventing the lamp from going out.

This object is achieved in accordance with the invention on the one hand by an electronic circuit having the features detailed in claim 1, by a lighting system that comprises such a circuit and a high-pressure gas-discharge lamp connected thereto, and by a projector that comprises at least one such circuit.

The object is achieved in accordance with the invention on the other hand by a corresponding method that has the steps detailed in claim 11.

The idea on which the invention is based is that, in a suitably designed lamp-current regulating unit, the lamp current is able to drop automatically when the input voltage falls without the input voltage having to be measured for this purpose and without any special regulating means having to be brought into action to bring about the drop. This is achieved in accordance with the invention by giving the lamp-current regulating unit the properties of a transconductor. A transconductor of this kind is able to convert changes in an incoming voltage into corresponding changes in an outgoing current, thus producing a positive feedback effect between the input voltage and the output current. Hence, the lamp-current regulating unit according to the invention regulates the lamp current chiefly in the accustomed way, i.e. in particular in such a way that a desired lamp power is obtained. This conventional regulation may operate relatively slowly in this case and may, for example, only go into action every 10 ms to adjust the controlled variable. What is more, because of the transconductive property with which the lamp-current regulating unit is provided in accordance with the invention, the power drawn from the energy storage means is at once reduced as soon as the voltage in the energy storage means drops, and does so without the need for any action to be taken by the power regulating means.

It is an advantage of the circuit according to the invention that a particularly small energy storage means can be used while at the same time it is still ensured that any premature extinction of the lamp is prevented if there is an interruption in the line voltage or a voltage dip on the a.c. line-supply system.

It is also an advantage of the circuit according to the invention that it responds particularly quickly because changes in the input voltage to the lamp-current regulating unit have a direct effect on the latter's output without any delays being caused by a regulator.

Advantageous embodiments of the circuit according to the invention form the subjects of the subclaims.

In one preferred embodiment, the circuit according to the invention additionally comprises noise regulating that, to a limited degree, counteracts the drop in current caused by the transconductive properties of the lamp-current regulating unit. In this way, the means for correcting for disruptive factors prevents natural fluctuations in the voltage from the capacitor, which are inevitable in view of the non-constant power flow on the single-phase line-supply system, from initially having no effect on the curve followed by the lamp power. For this purpose, the means of correcting for disruptive factors may compare either the voltage at the energy storage means with a preset nominal voltage, or the lamp current with a preset desired lamp current, or if required may do both. At the same time, the effectiveness of the means for correcting for disruptive factors is limited such that the drop in the voltage from the energy storage means can be corrected only within a limited range.

What is more, a means for correcting for disruptive factors of this kind can ensure that, if there is a reduction in the lamp current due to the transconductive properties, the lamp power will not drop below a minimum level for as long as the energy storage means is still able to supply an adequate voltage for this purpose. This is important because there are lower limits, which also depend on the length of the drop, set for the drop in power, particularly with high-pressure gas-discharge lamps. Hence a combination of the transconductive properties and the means for correcting for disruptive factors should ensure a minimum lamp current at which the energy storage means is able to supply the energy for a given minimum lamp current for as long as possible, such that the lamp will not go out during this period even at the minimum lamp current.

In another preferred embodiment of the electronic circuit according to the invention, the means for limited correction for disruptive factors is implemented as a program for a microcontroller.

These and other aspects of the invention are apparent from and will be elucidated with reference to the embodiments described hereinafter.

Figure 1:
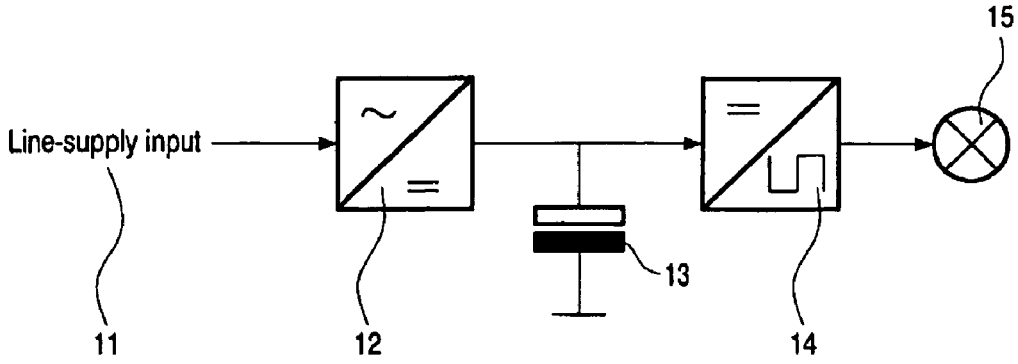
FIG. 1 (Prior Art)
FIG. 1 is a block circuit diagram of a circuit known from the prior art for supplying power to a high-pressure gas-discharge lamp.

FIG. 1 has already been described in connection with the prior art.

A first embodiment of the invention is produced by a development of the electronic circuit of FIG. 1 in which the lamp-current regulating unit 14 has a buck converter having transconductive properties.

Figure 2:
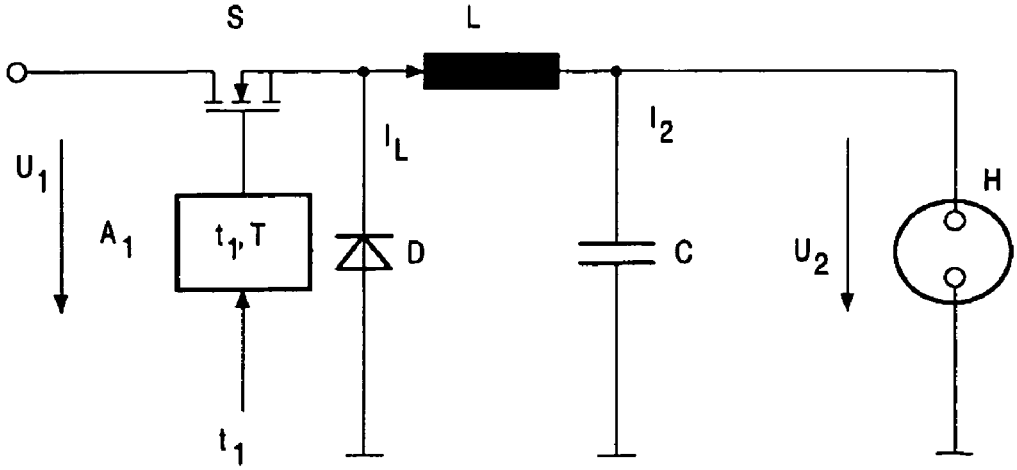
FIG. 2 shows a first embodiment of a power section of a lamp-current regulating unit of the circuit according to the invention.

FIG. 2 is a diagrammatic view of the buck converter of the first embodiment.

In the buck converter, a power transistor S controlled by a driver unit A1 is used as a switch. The transistor S is connected via a coil L to a first terminal of a high-pressure gas-discharge lamp H. The second terminal of the lamp H is connected to ground. The connection between the transistor S and the coil L is likewise connected to ground, via a freewheel diode D. The forward direction of the diode D is directed from ground towards the transistor S and coil L in this case. The connection between the coil L and the lamp H is connected to ground via a capacitor C. The voltage applied to the capacitor C is thus equal to that across the lamp H. For a.c. lamps, there is also an inverter (not shown), which produces an alternating current from the direct current coming from the buck converter, connected between the output of the buck converter and the lamp H. This has no bearing on the operation of the invention, and the elucidation given in what follows will, therefore, be confined to the example of a d.c. lamp.

An input voltage $U_1$ is applied to the power transistor S. If the transistor S is switched on by the driver unit A1, then the voltage $U_1$ causes a current $I_L$ to flow through the coil L and this current $I_L$, smoothed by the capacitor C, is supplied to the lamp H as a lamp current $I_2$. A voltage $U_2$ is applied across the lamp H in this case.

The buck converter shown, which is operated with a fixed on-time $t_1$ in so-called intermittent operation, provides the power section with the transconductive property in accordance with the invention.

Figure 3:
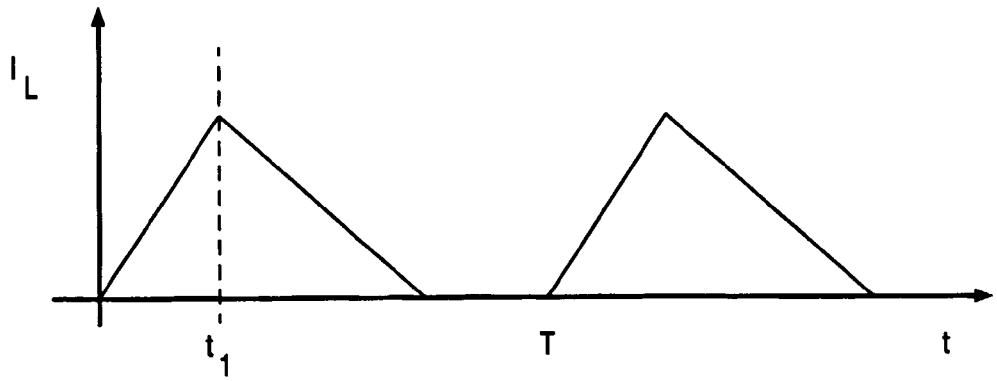
FIG. 3 shows the waveform of the current supplied by the power section of FIG. 2.

For intermittent operation, which is shown in FIG. 3, the driver unit A1 switches the transistor S on for an on-time $t_1$ each time. The current $I_L$ through the coil L rises linearly during the on-time $t_1$ and, when the transistor S is then switched off, declines again linearly to zero. This process is repeated each time after a period T that is set in the driver unit A1. The voltage $U_1$ applied to the buck converter is reflected in this case in the gradient at which the current rises and hence in the maximum level of the current $I_L$.

The controlling parameter for this arrangement is the on-time $t_1$, which can be preset for the driver unit A1 and which in the end produces a given mean lamp current. By making the period T of a suitable size, any required waveform for the lamp power as a function of the input voltage $U_1$ can be obtained in this case.

In intermittent operation, the waveform of the lamp current $I_2$ is given by the following equation:

$$I_2 = \frac{t_1}{T} \cdot \frac{U_1 \cdot (U_1 - U_2)}{2 \cdot L \cdot U_2}$$

The power section of FIG. 2 thus produces a quadratic power curve whose zero point always coincides with that of the lamp voltage.

Hence, the buck converter in FIG. 2 makes it possible for the lamp current to be matched automatically to the voltage available. In this way, the voltage drawn from the storage capacitor shown in FIG. 1 is reduced if there is an interruption in the line voltage or if there is an undervoltage, and as a result the period of the reduced or failed line voltage can be covered without the lamp going out with great reliability even with a relatively small storage capacitor 13. At the same time, the automatic matching makes it possible for a decline in voltage to be responded to very quickly.

Figure 4:
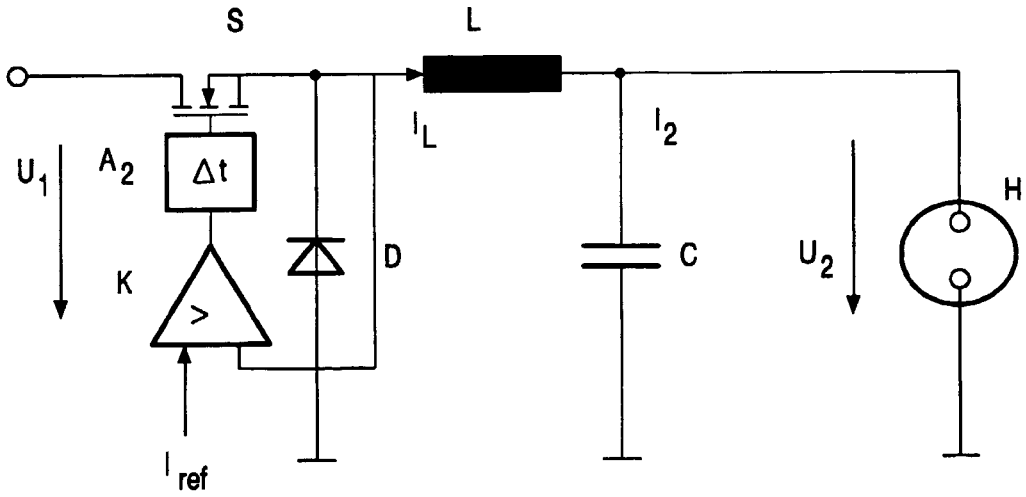
FIG. 4 shows a second embodiment of a power section of a lamp-current regulating unit of the circuit according to the invention.

FIG. 4 shows in diagrammatic form an alternative buck converter for a second embodiment of the invention. This buck converter, too, forms a power section in a lamp-current regulating unit forming a development of the electronic circuit of FIG. 1.

The construction of the buck converter in the second embodiment is, to a very large extent, the same as that of the buck converter of FIG. 2. The individual components of the circuit shown in FIG. 4 are, therefore, identified by the same reference numerals as the corresponding components of the circuit in FIG. 2. However, in the second embodiment the buck converter operates not in the intermittent mode but in the continuous mode. Control is effected not, as in the example in FIG. 2, by presetting substantially constant parameters for the on-times, but by means of a comparator. For this reason, the drive means for the transistor S are of a different form than those shown in FIG. 2.

A comparator K, to which a reference current $I_{ref}$ on the one hand and the present current $I_L$ through the coil L on the other hand are fed, is provided for drive purposes. The output of the comparator K is connected to a driver unit A2 that drives the transistor S and in which a waiting time Δt is programmed.

Figure 5:
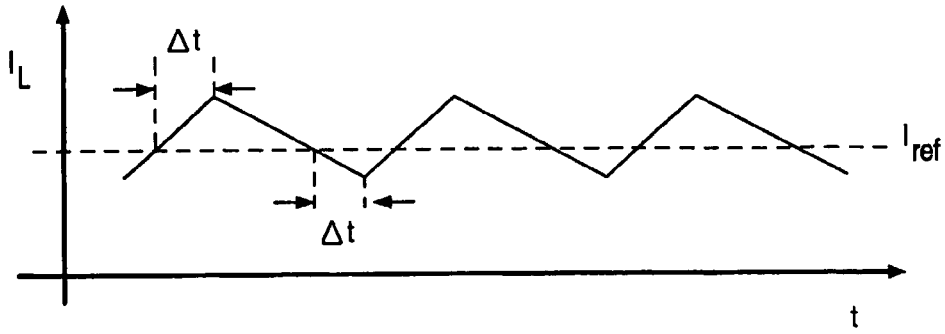
FIG. 5 shows the waveform of the current supplied by the power section of FIG. 4.

The current $I_L$ through the coil L that is obtained with this circuit is plotted in FIG. 5 against time t.

If the comparator K finds that the current $I_L$ through the coil exceeds the reference value $I_{ref}$, the driver unit A2 switches the power transistor S off after a waiting time Δt. Similarly, the power transistor S is switched on again by the driver unit A2 once the current $I_L$ through the coil drops below the current limit $I_{ref}$, after a waiting time Δt.

In the case of the comparator-controlled buck converter, the controlling parameter that directly affects the mean lamp current $I_2$ is the reference current $I_{ref}$. By giving the waiting time Δt a suitable value, any required waveform for the lamp power as a function of the input voltage $U_1$ can be obtained in this case.

With the comparator-controlled buck converter of FIG. 4, a waveform given by the following equation is obtained for the lamp current $I_2$:

$$I_2 = I_{Ref} + \frac{U_1}{2L\Delta t} - \frac{U_2}{L\Delta t}$$

The curve for power that is set up is one that is a linear function of the capacitor voltage $U_2$. The zero-point of the power curve depends on the preset reference current $I_{ref}$ in this case.

A special case arises if the bottom peak level of the curve for the current in the coil L reaches a value of 0. The diode D prevents the current from dropping further to negative values. As a result, as the input voltage declines, the current drops less swiftly than it did at the beginning. This fact can advantageously be exploited to ensure that power does not drop below a certain minimum level.

Thus the comparator-controlled buck converter allows the same advantages to be obtained as the buck converter in the first embodiment.

Figure 6:
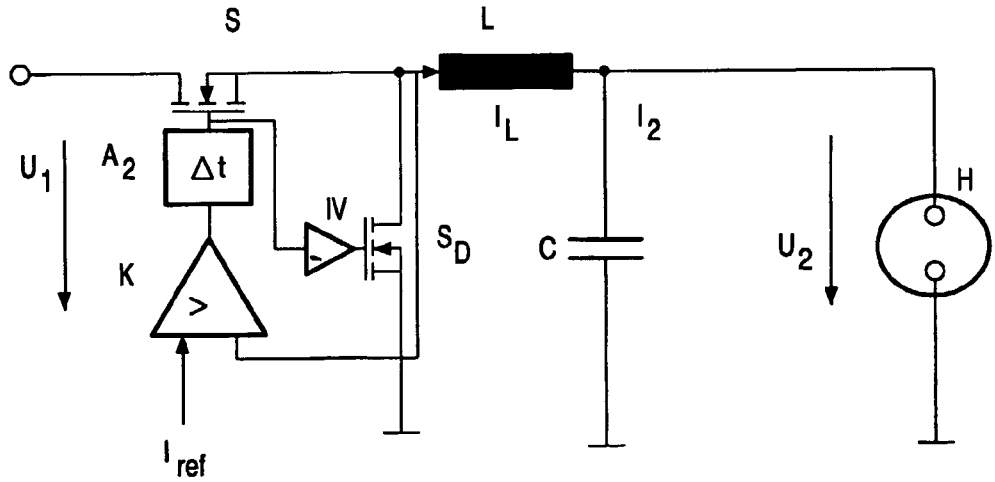
FIG. 6 shows a third embodiment of a power section of a lamp-current regulating unit of the circuit according to the invention.

A further embodiment of a comparator-controlled buck converter, with which the same advantages can likewise be achieved, is shown in FIG. 6. The construction of this buck converter is exactly the same as that of the buck converter of FIG. 4 except that the diode D is replaced by a field-effect transistor $S_D$. Any other desired switchable means could be used in place of the power transistor $S_D$ in this case provided it was capable of allowing both negative and positive currents to flow in the on-state. Like the power transistor S, the power transistor $S_D$ is driven from the output of the driver unit A2, although in this case there is also an inverter IV connected between the driver unit A2 and the base of transistor $S_D$. As a result, the switched state of the second transistor $S_D$ is always the opposite of that of transistor S. This circuit is also known as a two-quadrant converter because it allows energy to flow both from the input end of the circuit to which the voltage $U_1$ is applied to the lamp H and from the lamp H to the input end of the circuit.

The circuit shown in FIG. 6 can be provided with a transconductive property in the same way as the circuit shown in FIG. 4, for which purpose a suitable reference current $I_{ref}$ and a suitable waiting time Δt are once again set. The arrangement also obeys the same law that the lamp current is dependent on the input voltage. However, unlike the arrangement having a diode, the arrangement in FIG. 6 also allows the current in the inductor L to be negative. The circuit shown in FIG. 6 is thus not a special case, and the zero-point for the current is obtained in exactly the same way from the equation drawn up for FIG. 4.

Figure 7:
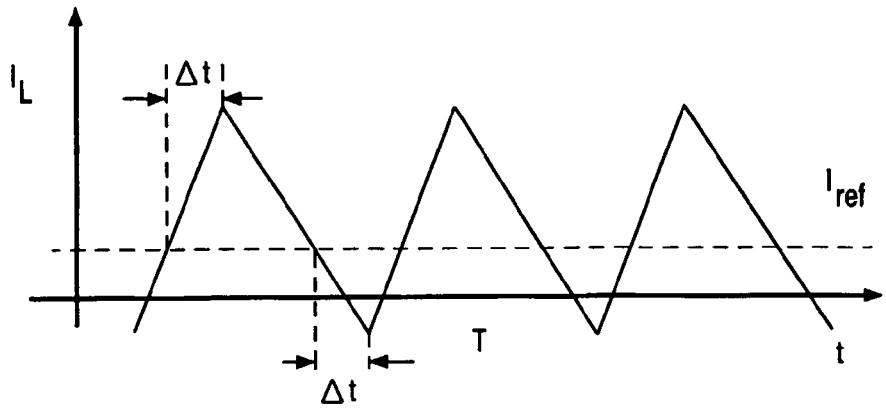
FIG. 7 shows the waveform of the current supplied by the power section of FIG. 6.

A typical curve for the current $I_L$ through the coil L is shown in FIG. 7 for the buck converter of FIG. 6. The curve is the same as that shown in FIG. 5 except that there are also negative values of the current $I_L$.

Figure 8:
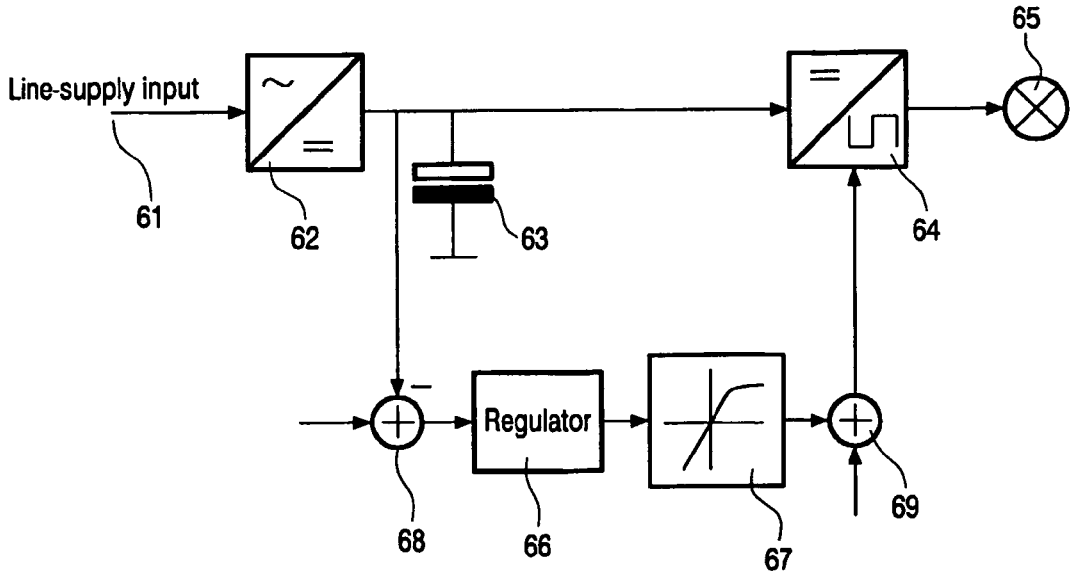
FIG. 8 shows a first embodiment of an additional means of correcting for disruptive factors in a circuit according to the invention.
Figure 9:
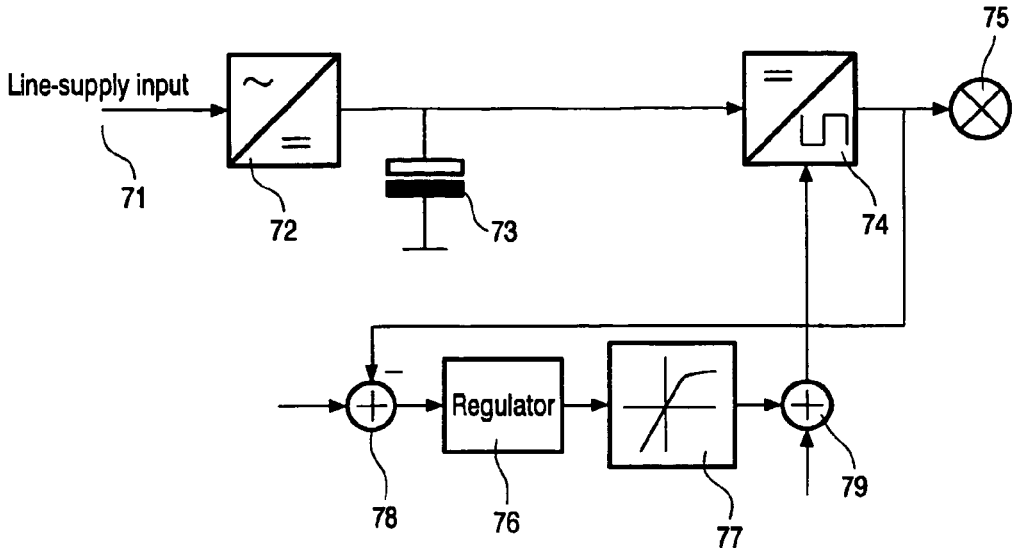
FIG. 9 shows a second embodiment of an additional means of correcting for disruptive factors in a circuit according to the invention.

The changes in the capacitor voltage should be counteracted within certain limits to achieve that the regulating means according to the invention will not produce any unwanted change in the power to the lamp at each and every one of the inevitable minor changes in the voltage of the capacitor. FIGS. 8 and 9 each show supplementary means for correcting for disruptive factors that can be used for this purpose.

Like the electronic circuit shown in FIG. 1, the two Figures contain respective line-supply input sections 62 and 72, capacitors 63 and 73, lamp-current regulating units 64 and 74, and lamps 65 and 75. In accordance with the invention, the lamp-current regulating units 64 and 74 have a transconductive property in this case, obtained, for example, by the use of one of the buck converters shown in FIGS. 2, 4 and 6.

For the supplementary correction for disruptive factors, the voltage across the capacitor 63 is, in addition, sensed in FIG. 8. The difference, determined by an adder 68, between a preset nominal value for the capacitor voltage and the voltage value actually sensed is fed to a regulator 66. The output from the regulator 66 is fed to a limiter 67. The output from the limiter 67 is added to a preset value by a second adder 69 and used to drive the lamp-current regulating unit 64.

In FIG. 9, by contrast, it is the actual lamp current that is sensed for the supplementary correction for disruptive factors. The difference, determined by an adder 78, between a preset nominal value for the lamp current and the lamp current actually sensed is fed to a regulator 76. As in FIG. 8, the output from the regulator 76 is fed to a limiter 77. The output from the limiter 77 is also added to a preset value by a second adder 79 and used to drive the lamp-current regulating unit 74.

Hence, the only difference between the means for correcting for disruptive factors in FIGS. 8 and 9 is that in one case the deviations of the capacitor voltage from the nominal voltage are determined by the adder 68 and in the other the deviations of the lamp current from a desired current are determined by the adder 78.

In either cases, a regulating signal corresponding to the output of the adder 68, 78 is formed in the respective regulator 66, 76. The intention is then that the regulating signal should act on the respective lamp-current regulating unit 64, 74 in such a way that any drop in voltage is compensated for and the lamp current is prevented from dropping. The effect of the regulating signal is, however, limited by the respective limiter 67, 77 so that, if the capacitor voltage continues to fall, a reduction in the lamp current will automatically be performed in accordance with the invention from that point on. The output of the limited means for correcting for disruptive factors is then superimposed on the original control signal to the lamp-current regulating unit by means of the relevant adder 69 or 79.

Depending on the regulator 66 or 76 that is used, the limiter may also be arranged upstream of the regulator 66 or 76.

Figure 10:
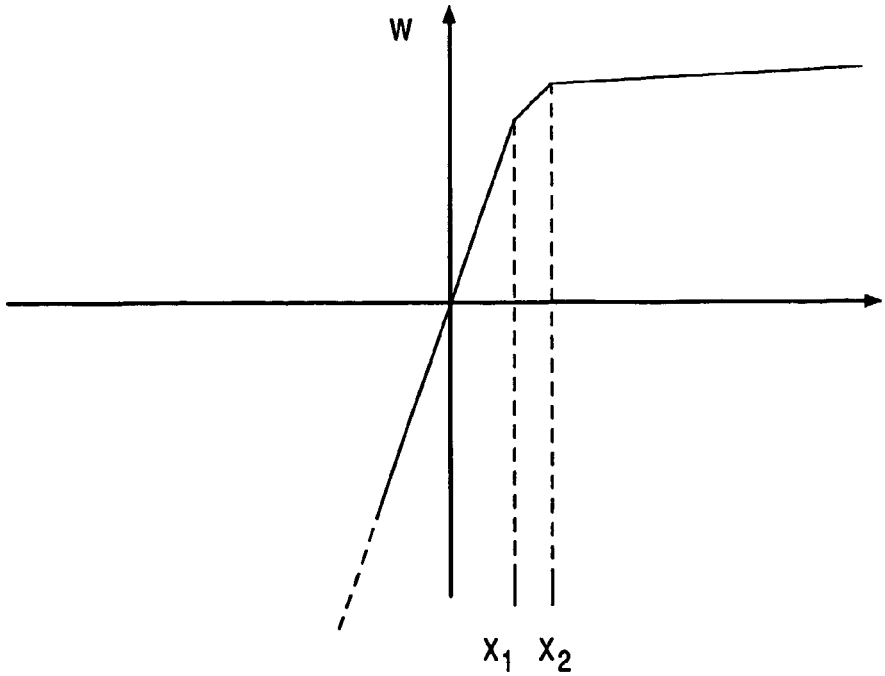
FIG. 10 shows an example of a limitation applied to the means of correcting for disruptive factors of FIG. 8 or 9.

FIG. 10 shows a possible function that is implemented in the limiter 67 or 77. The Figure shows a graph in which the x-axis represents the values of the output signal from regulator 66 or 76, and the y-axis, which is marked W, represents the values of the output signal from limiter 67 or 77. As shown by the curve plotted, any possible regulator output signal has a limiter output signal associated with it, and the influence of the means for correcting for disruptive factors on the current-regulating means is thus limited.

In the graph, the limiter output signal rises to a first positive value X1 proportional to the regulator output signal at a relatively steep gradient, which means that a small increase in the regulator output signal produces a larger rise in the limiter output signal. Between value X1 and a second positive value X2 the gradient is reduced, as a result of which the limiter output signal rises by approximately the same amount as the regulator output signal over this range. From value X2 on, the gradient of the curve is only minimal, i.e. there is virtually no further change in the limiting signal as the regulator output signal rises.

X1 and the gradient over this first range are selected in such a way that the natural fluctuations caused by the non-constant flow of power on the single-phase supply system do not have any effect yet. X2 is selected in such a way that stable regulating behavior is obtained at the changeover to uncorrected operation. The minimum effectiveness that is obtained due to the low gradient above X2 is so selected that a maximum operating duration is obtained prior to extinction in the event of a total interruption.

Figure 11:
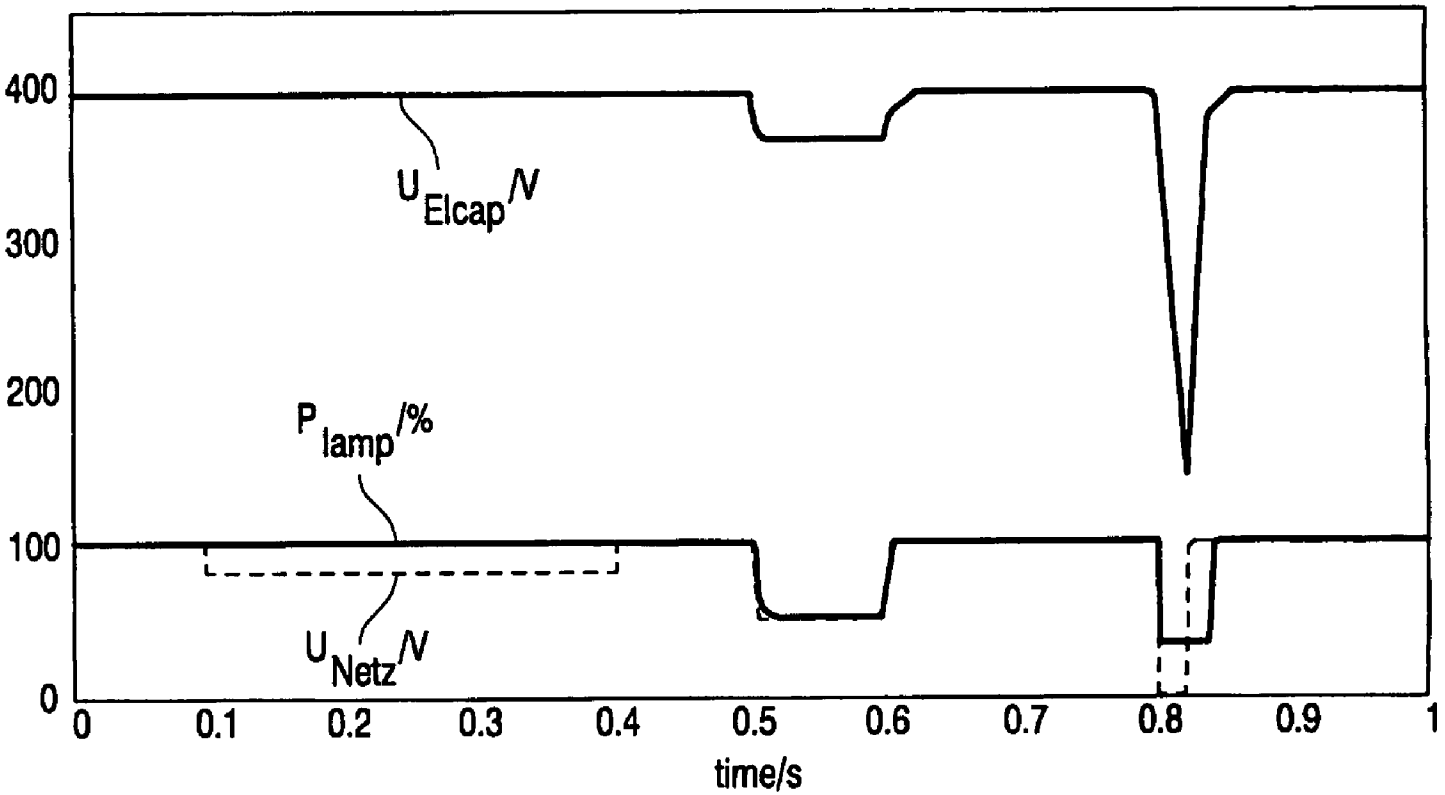
FIG. 11 shows illustrative waveforms for the line voltage, capacitor voltage and lamp power in a power supply according to the invention.

Finally, there are shown in FIG. 11 illustrative curves for the line supply voltage, the voltage across the storage capacitor, and the lamp power over a period of one second. The solid curve at the top is the voltage $U_{Elcap}$ across the storage capacitor in volts, the solid curve at the bottom is the lamp power $P_{Lamp}$ in %, and the dotted curve is the line-supply voltage $U_{Mainz}$ in volts.

The nominal line-supply voltage is 100 V in this case, which corresponds to a capacitor voltage of 400 V. A lamp power $P_{Lamp}$ of 100% is obtained at these voltages.

In a temporal range between 0.1 s and 0.4 s, there is a slight drop in the line-supply voltage $U_{Mainz}$ within the limits applicable to normal voltage fluctuations. Despite its fairly long duration, this does not as yet have any effect on the capacitor voltage $U_{Elcap}$ and hence no effect on the lamp power $P_{Lamp}$ either, which is regulated as a function of the capacitor voltage $U_{Elcap}$ available. Even if there were a slight decrease in the capacitor voltage $U_{Elcap}$, the supplementary means for correcting for disruptive factors would counteract any reduction in the lamp current in order to prevent any fluctuation in the lamp power and hence any inconvenience to the user.

Over a temporal range between 0.5 s and 0.6 s, this is followed by a drop in the line-supply voltage $U_{Mainz}$ to approximately 50% of its nominal value. The line-supply input section 12 and the capacitor 63 or 73 are not designed to maintain the voltage at the full lamp power during this 100 ms period. As soon as the capacitor voltage $U_{Elcap}$ drops, the lamp current, and hence the resulting lamp power $P_{Lamp}$, drop in accordance with the invention. Because of the supplementary means 66–69 or 76–79 for correcting for disruptive factors, the reduction takes place with a certain delay in this case because the drop is first of all corrected for until it goes beyond the range of natural voltage fluctuations at the energy storage means. The size of the reduction is given by the remaining capacitor voltage $U_{Elcap}$ and the transconductive property. This ensures that the lamp power $P_{Lamp}$ can be maintained during a period of undervoltage, which period in all probability will not be exceeded. At the same time, the inconvenience to the user of the lamp 65 or 75 is kept to the unavoidable minimum.

Finally, at 0.8 s, there is a complete interruption in the line-supply voltage $U_{Mainz}$ for a brief period, and during this period the capacitor voltage $U_{Elcap}$ drops to almost ¼ of the line-supply voltage. Due to the transconductive property according to the invention, there is thus, after a short delay caused by the means of correcting for disruptive factors, a severe reduction in the lamp current and hence in the lamp power $P_{Lamp}$ that is shown. The lamp current is reduced in this case as far is possible for an interruption of the maximum duration that may, in all probability, be expected, to prevent the lamp 65 or 75 from going out.

The measures described enable the size of the electrolytic capacitor to be reduced to approximately ⅓ of the typical size.

The embodiments described may be varied in a wide variety of ways.

The invention claimed is:

1. An electronic circuit for supplying energy to a high-pressure gas-discharge lamp (H, 65, 75), wherein the electronic circuit comprises a line-supply input section (62, 72) to receive and convert an a.c. voltage from an a.c. line-supply system (61, 71), an energy storage means (63, 73) to store the energy put out by the line-supply input section (62, 72), and a lamp-current regulating unit (64, 74) that is supplied with an input voltage ($U_1$) by the line-supply input section (62, 72) via the energy storage means (63, 73) and that makes available a lamp current ($I_2$) for a high-pressure gas-discharge lamp (H, 65, 75), characterized in that the lamp-current regulating unit (64, 74) has a power section (L, D, C, S, A1, A2, K, $S_D$, IV) having a transconductive property that, in the event of the input voltage ($U_1$) dropping, automatically causes a reduction in the lamp current ($I_2$) supplied to the high-pressure gas-discharge lamp (65, 75, H).

2. An electronic circuit as claimed in claim 1, characterized in that the power section having a transconductive property comprises a buck converter (L, D, C, S, A1) having controllable switching means (S), the buck converter being operated in intermittent operation with a substantially constant on-time ($t_1$) that is preset for the desired state of operation of the high-pressure gas-discharge lamp (65, 75, H) and with a preset period (T) between successive fresh switch-ons of the switching means (S).

3. An electronic circuit as claimed in claim 1, characterized in that, to provide a transconductive property, the power section (L, D, C, S. A2, K, $S_D$, IV) has the function of a comparator-controlled buck converter, for which function the power section (L, D, C, S, A2, K, $S_D$, IV) comprises drivable switching means (S), the switching means (S) being switched off after a fixed waiting time (Δt) each time a current flowing in a connection between the switching means (S) and the lamp (H) exceeds a preset limiting value ($I_{ref}$) and being switched on after a fixed waiting time (Δt) each time a current flowing in a connection between the switching means (S) and the lamp (H) drops below a preset limiting value ($I_{ref}$).

4. An electronic circuit as claimed in claim 3, characterized in that, to provide the function of a comparator-controlled buck converter, the power section (L, D, C, S. A2, K) further comprises at least one inductor (L), one diode (D), and one capacitor (C), the switching means (S) feeding current to a lamp (H) via the inductor (L), the diode (D) connecting the inductor (L) to ground at the side of the switching means (S) opposite to its forward direction, and the capacitor (C) connecting the inductor (L) to ground at the side remote from the switching means (S).

5. An electronic circuit as claimed in claim 3, characterized in that, to provide the function of a pure buck converter or a two-quadrant converter, the power section (L, C, S, A2, K, $S_D$, IV) further has at least one inductor (L), further controllable switching means ($S_D$), and a capacitor (C), the first controllable switching means (S) feeding current to a lamp (H) via the inductor (L), the further controllable switching means ($S_D$) connecting the inductor (L) to ground at the side of the switching means (S) and being driven in the opposite direction to the first controllable switching means (S), and the capacitor (C) connecting the inductor (L) to ground at the side remote from the switching means (S).

6. An electronic circuit as claimed in claim 1, characterized by means (66, 67, 69) for an additional correction for disruptive factors, said means (66, 67, 69) receiving the deviation of the voltage across the energy storage means (63) from a preset nominal value as an input signal, and, if a drop is detected in the voltage across the energy storage means (63), the means (66, 67, 69) counteracting, to a limited degree, any reduction in lamp current caused by the transconductive property of the power section (L, D, C, S, $S_D$, A1, A2, K) of the lamp-current regulating unit (64).

7. An electronic circuit as claimed in claim 6, characterized in that the means (66, 67, 69; 76, 77, 79) for the additional correction for disruptive factors prevent the lamp current supplied by the lamp-current regulating unit (64, 74) from being reduced to below a preset minimum value for as long as enough voltage is available for this purpose in the energy storage means (63, 73).

8. An electronic circuit as claimed in claim 6, characterized in that the means (66, 67, 69; 76, 77, 79) for the additional correction for disruptive factors comprise a regulator (66, 76) and a limiter (67, 77).

9. An electronic circuit as claimed in claim 6, characterized in that at least the additional correction for disruptive factors is implemented in the form of a program for a microcontroller.

10. An electronic circuit as claimed in claim 1, characterized by means (76, 77, 79) for an additional correction for disruptive factors, said means (76, 77, 79) receiving the deviation of the lamp current from a preset desired value as an input signal, and, if a drop is detected in the lamp current, the means (76, 77, 79) counteracting, to a limited degree, any reduction in lamp current caused by the transconductive property of the power section (L, D, C, S, A1, A2, K) of the lamp-current regulating unit (74).

11. A lighting system having an electronic circuit as claimed in claim 1 and having a high-pressure gas-discharge lamp (65, 75, H) connected to the lamp-current regulating unit (64, 74).

12. A projector that has an electronic circuit as claimed in any claim 1 to supply energy to a high-pressure gas-discharge lamp (65, 75, H).

13. A method of supplying energy to a high-pressure gas-discharge lamp (65, 75, H) wherein the method has the following steps:

a) receiving and converting an a.c. voltage from an a.c. line-supply system (61, 71) by a line-supply input section (62, 72), b) storage of the energy of the converted voltage in an energy storage means (63, 73), c) application of an input voltage to a lamp-current regulating unit (64, 74) by the energy storage means (63, 73), d) supply of a lamp current for a high-pressure gas-discharge lamp (65, 75, H) by the lamp-current regulating unit (64, 74), and e) variation of the lamp current supplied, if there is a varying input voltage to the lamp-current regulating unit (64, 74), by means of a transconductive property of the lamp-current regulating unit (64, 74).

14. A method as claimed in claim 13, characterized in that, in step e), the variation of the lamp current supplied is counteracted to a limited degree by a noise regulating means.

* * * * *